United States Patent [19]

Storch et al.

[11] 4,051,487

[45] Sept. 27, 1977

[54] FILM FONT FOR PHOTOCOMPOSING APPARATUS

[75] Inventors: Leonard Storch, New York, N.Y.; George H. Thomas, Dallas, Tex.

[73] Assignee: Leonard Storch Enterprises, Inc., New York, N.Y.

[21] Appl. No.: 661,948

[22] Filed: Feb. 27, 1976

[51] Int. Cl.[2] ..... B41B 13/00

[52] U.S. Cl. ..... 354/12; 40/158 B

[58] Field of Search ..... 354/12, 13, 14, 15, 354/16, 17, 18, 19, 292, 354; 40/152, 152.1, 156, 158

[56] References Cited

U.S. PATENT DOCUMENTS

| | | | |
|---|---|---|---|
| 3,665,825 | 5/1972 | Friedel | 354/12 |
| 3,710,707 | 1/1973 | Hanson et al. | 354/14 |
| 3,721,174 | 3/1973 | Tidd | 354/13 |
| 3,738,236 | 6/1973 | Grube | 354/15 |
| 3,921,182 | 11/1975 | Hansen et al. | 354/15 |

*Primary Examiner*—L. T. Hix
*Assistant Examiner*—Alan Mathew
*Attorney, Agent, or Firm*—Amster & Rothstein

[57] ABSTRACT

A film font for use in conjunction with photocomposing equipment includes a rectangular piece of film having a pair of apertures at either end spaced to fit over a corresponding number of support pins on a font-carrying drum. The film element includes, at one end, a rigidifying bar adapted to fit snugly against the first paid of pins and, at the other end, a cam action slide adapted to lock against the second set of pins to maintain the font in rigid position.

5 Claims, 8 Drawing Figures

FILM FONT FOR PHOTOCOMPOSING APPARATUS

This invention relates generally to photocomposing equipment and more specifically to a film font adapted to be supported on a rotating drum or similar surface.

In photocomposing devices, a variety of arrangements are provided to permit mounting of a film font (a small piece of film containing all necessary letters, numerals and symbols in a particular type style) on a drum or other font-mounting surface. One such system is shown in U.S. Pat. No. 3,738,236 wherein a film font is secured to a rotating drum, the drum being moved with respect to a series of lamps and shutters to position the font for exposure of each letter. In systems of this type, the drum or other support surface generally moves quickly with sharp and frequent reverses of direction so that it is particularly important that the font be firmly secured to the support structure. At the same time, the font must be carefully aligned to coincide with the illumination system to be sure that each character is in proper alignment for exposure.

Prior mounting systems generally include spring means for retaining the film font in proper position on appropriate mounting pegs or pins. It has been found, however, that mounting arrangements of this type are relatively delicate and easily distorted. In addition, it has been found that when spring means are used to retain the font, sharp motions of the font against the urging of the spring may permit some undesirable movement of the font.

Accordingly, it is an object of the present invention to provide a film font support system which is more secure and more reliable then systems heretofore available. A further object of the invention is to provide a new, improved font construction which does not rely on spring means to retain the font in position.

In accomplishing these and other objects in accordance with the present invention, a film font adapted to be mounted on a plurality of support pins includes a rigidifying member adjacent one edge of the font, with a pair of apertures in the font adjacent the rigidifying member so as to receive a first pair of support pins. The opposite end of the film font includes a second pair of apertures adapted to receive a second pair of support pins and a rigid cam slide bar. The slide bar, when in open position, permits the film font to be mounted on the support pins and, when in closed position, tightens against the support pins to securely hold the font.

Further objects, features and advantages of the present invention will be more fully appreciated by reference to the following detailed description of a presently preferred but none the less illustrative embodiment of the invention when read in conjunction with the appended drawings, wherein.

Figure 1:
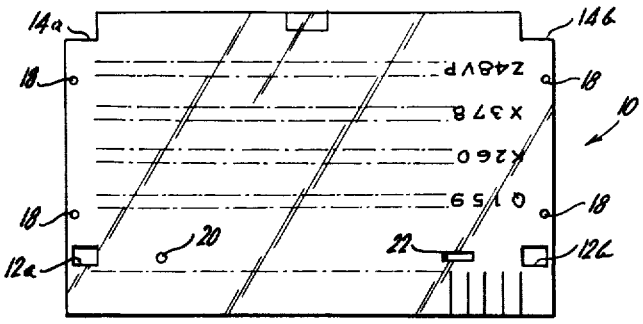
FIG. 1 is a front view of the film portion of applicant's film font.

Referring to the drawings, FIG. 1 shows the film portion 10 of applicant's film font. Note that the film bears columns of letters, numbers, and symbols all customarily of a single type style. For simplicity only a representative portion of the material on the font is shown. These letters and numerals are aligned with a series of timing marks at the lower end of the film which are adapted to cooperate with the optical system to obtain proper alignment of the font in a manner known in the art.

Film 10 includes a pair of rectangular apertures 12*a* and 12*b* at opposite ends thereof at the lower portion of the film and the upper corners of the film are cut out at 14*a*, 14*b*, both to accommodate mounting pins on a font-carrying drum 16 (shown in FIG. 2) or similar mounting surface. In addition, the film 10 is punched with four rivet holes 18, an alignment aperture 20 and an alignment slot 22.

Figure 2:
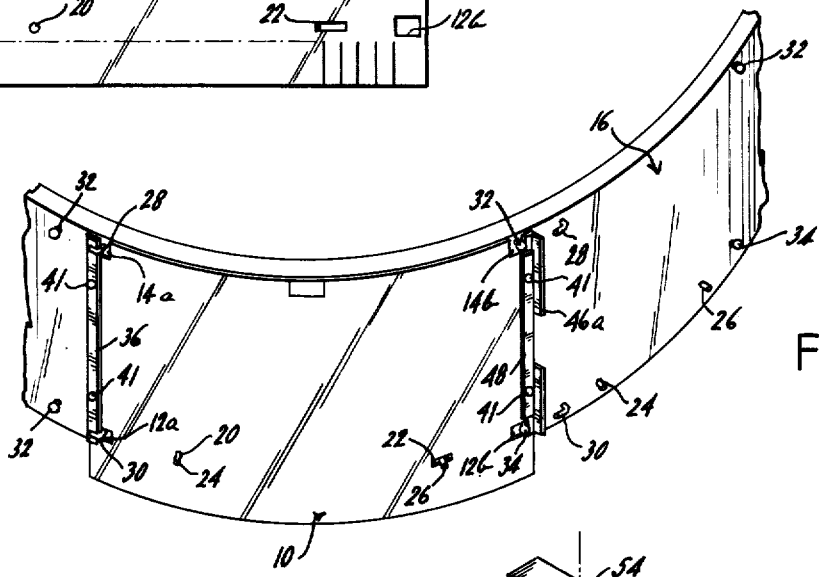
FIG. 2 is a perspective view of applicant's film font latched in position on a typical film font-carrying drum.

FIG. 2 shows a typical mounting drum 16 including mounting pins 28, 30, 32, and 34, an alignment pin 24 (adapted to be received in alignment aperture 20) and an alignment pin 26 (adapted to be received in alignment slot 22). As FIG. 2 also shows, a plurality of font mounting positions may be incorporated on a single drum to provide a variety of typefaces without removing and replacing fonts.

Figure 3:
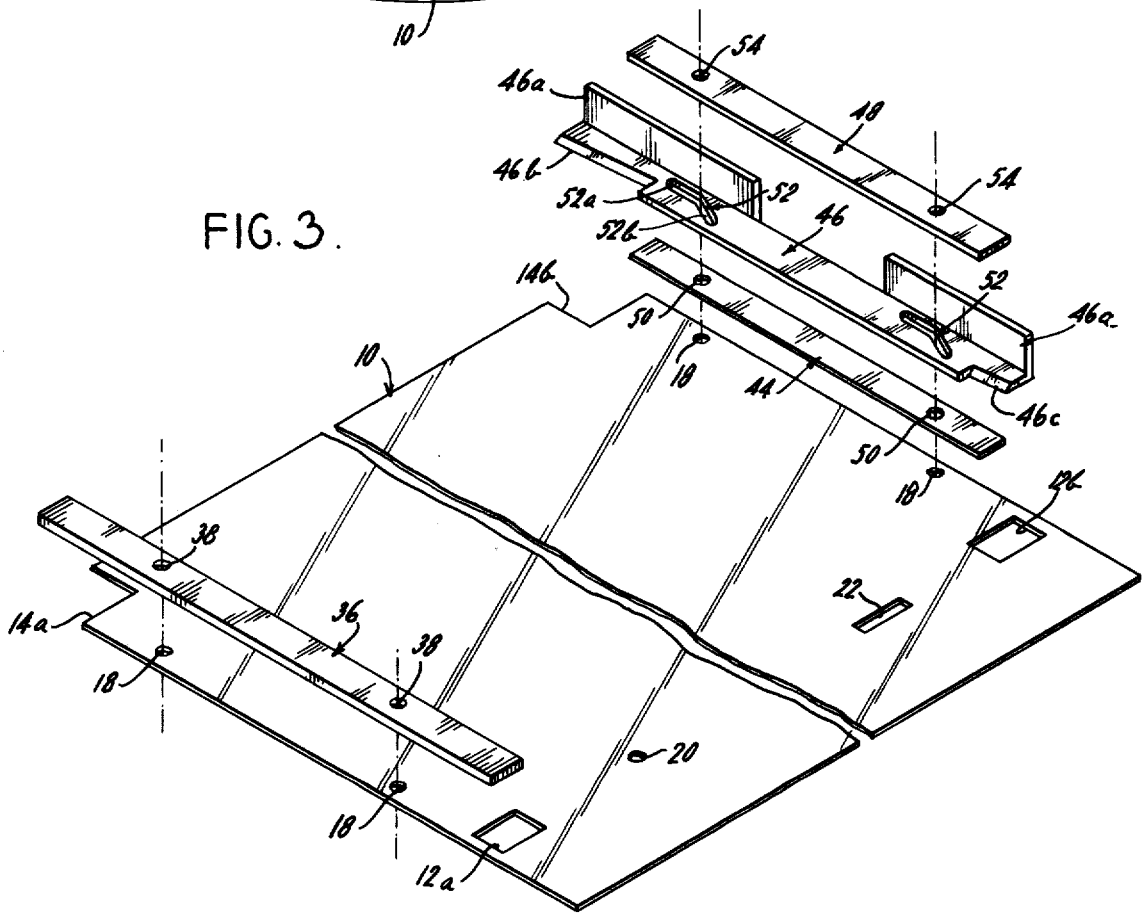
FIG. 3 is an exploded view of applicant's film font, with a portion broken away.
Figure 8:
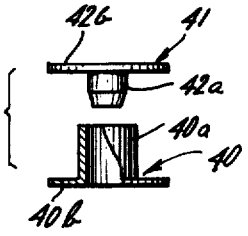
FIG. 8 is a front view, partially broken away, of a rivet used in applicant's font construction.

The mounting hardware on applicant's film font is best shown in FIG. 3 and includes a stiffening bar 36 which is riveted to the film font at a first end thereof. Stiffening bar 36 includes a pair of rivet holes 38 (which align with rivet holes 18 on film 10) and is attached to film 10 by use of rivets of the type shown in FIG. 8. These rivets (generally designated 41) include a base part 40 having a shaft receiving sleeve portion 40*a* and a base flange portion 40*b*; and a rivet part 42 having a depending rivet shaft 42*a* and a flange section 42*b*. Shaft portion 42*a* is tapered slightly adjacent to its lower end and the sleeve 40*a* is dimensioned such that a tight press fit is established once the rivet is driven into the sleeve.

Figure 4:
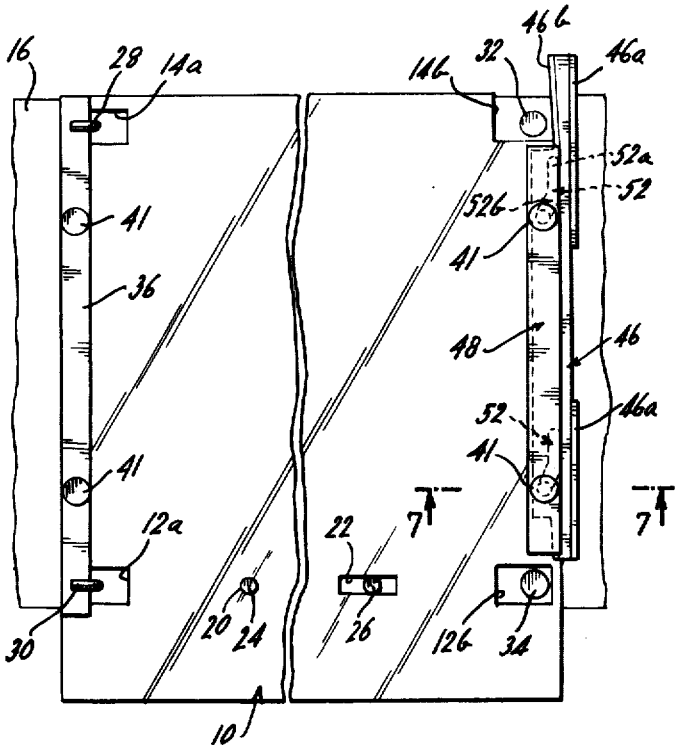
FIG. 4 is a broken front view of applicant's film font in place on a font-carrying drum with the slide mechanism in its fully opened position.

Stiffening member 36 is shown in its riveted position on the left-hand side of FIG. 4. Note that member 36 extends across openings 12*a* and 14*a* so as to accommodate pins 28 and 30 on drum 16. As shown in the drawings herein, pins 28 and 30 are angled pins which extend outwardly from the drum and then to the left (in FIG. 2). Alternately, these may be ballhead type pins similar to pins 32, 34, or may be of a variety of other configurations.

The end of the font 10 opposite bar 36 includes a cam action slide arrangement which permits the font to be locked onto the drum. The three exploded parts of the cam action slide are best shown in FIG. 3 and include a base strip 44 which is positioned along the edge of the film in contact with the film, a cam action slide member 46 which is positioned immediately above base strip 44 and a covering member 48 which is positioned above slide 46. It will be appreciated that FIG. 3 shows these parts in exploded view and that when assembled, elements 44, 46 and 48 are stacked on film 10 adjacent the film edge with rivet holes 50 in strip 44, cam action slots 52 in slide 46 and rivet holes 54 in strip 48 in alignment to receive rivets of the type shown in FIG. 8.

Figure 7:
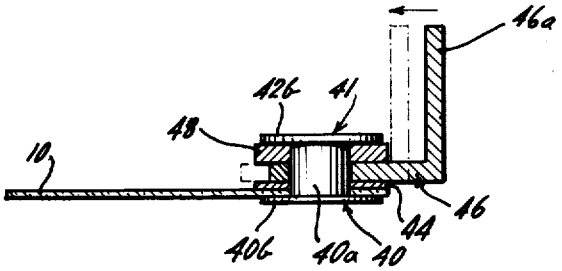
FIG. 7 is a cross-sectional view taken along line in FIG. 4.

The cam action slide arrangement is shown in its fully assembled condition in the right-hand portion of FIG. 4 and the relative position of the various elements is shown in greater detail in the cross-sectional view of FIG. 7.

Figure 6:
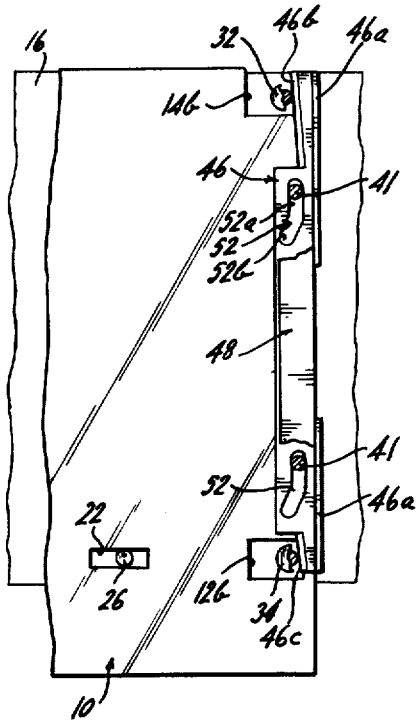
FIG. 6 is a view similar to FIG. 5, with the slide in fully closed position.
Figure 5:
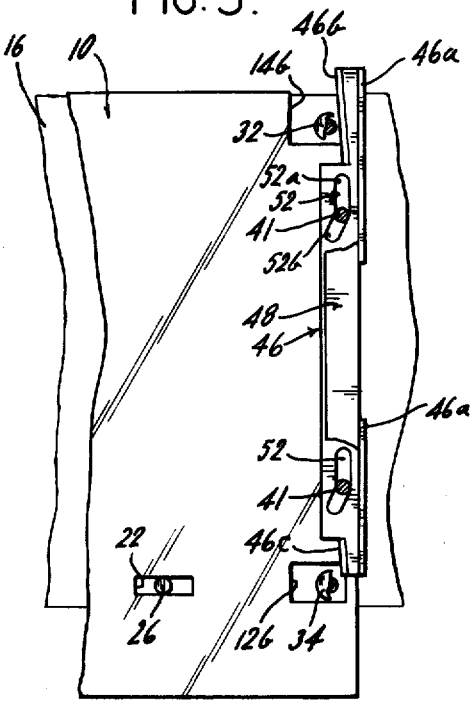
FIG. 5 is a front view of the right-hand portion of applicant's font showing the slide in an intermediate position.

The operation of the slide clamp will be appreciated by comparison of FIGS. 4, 5 and 6. FIG. 4 shows the slide in its fully-opened position with the slide member 46 fully extended upwardly. Note that cam slots 52 include an upper parallel section 52*a* parallel to the right-hand edge of the film and an angled lower section 52*b* which angles inwardly away from the film edge. In mounting the font on drum 16, the slide is raised to its uppermost position at which point rivets 41 will seat in the lowermost edge of cam slot 52. In this condition, the font is placed on the drum by inserting pins 28, 30 in openings 14*a*, 12*a* and laying the font on the drum so that pins 32, 34 are received in apertures 12*b*, 14*b*. It will be appreciated that pins 32, 34 each comprise a round ball element attached to the drum by a short stem.

To lock the font in position, slide 46 is moved downwardly through the intermediate position shown in FIG. 5 to a locked position shown in FIG. 6. As the slide moves from its open position (FIG. 4) to its intermediate position (FIG. 5), the stems of rivets 41 pass from the bottom of the lower angled sections 52*b* of cam slots 52 to the top of angled sections 52*b* so that as slide 46 is moved downwardly, it also moves laterally inwardly on the film and approaches pins 32, 34. Note that the slide includes an upstanding portion 46*a* which functions to provide a handle for the slide and to rigidify and stiffen the slide.

At its intermediate position (FIG. 5), the slide 46 does not yet engage pins 32, 34 so that the font is not yet in locked position.

As the slide continues to move from its intermediate position (FIG. 5) to its locked position (FIG. 6), the stem of rivets 41 passes from the bottom to the top of the upper parallel sections 52*a* of cam slots 52 so that the slide moves in a path parallel to the edge of the film. However, slide 46 includes upper and lower pin engagement edges 46*b*, 46*c* which are angled obliquely with respect to the direction of travel of the slide as it moves between the intermediate position (FIG. 5) and the locked position (FIG. 6). The angle and length of these engagement edges are selected so that as slide 46 moves downwardly between the intermediate position and the locked position, edge 46*b* comes into contact with pin 32, while edge 46*c* substantially simultaneously comes into contact with pin 34, rigidly locking the font in position. The elements are dimensioned such that in its final locked position (FIG. 6), rivets 41 may not be quite at the top of slot 52. This slight degree of play allows for manufacturing tolerances and wear and permits the slide mechanism to consistently form a tight and secure lock. It should also be understood that the locked position may vary slightly from machine to machine depending on variation of the relevant dimensions.

Note also, that the engaging edges 46*b* and 46*c* of the slide 46 are preferably beveled so that the angled portion of the engaging edges tightens against the ball at a position lower on the ball than would occur without the bevel providing a greater and more stable contact area between the edges and the ball.

It will be appreciated that the ability of slide 46 to slide in the space between bottom strip 44 and top strip 48 is determined by the fit between the three strips, the film to and rivet 41. As will be apparent, the tighter the rivet (i.e., the shorter the distance between bottom flange 40*b* and top flange 42*b*), the tighter the grasp on the slide 46 and the stiffer and more difficult it will be to move slide 46. The fit of rivet 41 is selected so that slide 46 is stiff enough to prevent undesired motion of the slide but loose enough so as to permit the slide to be moved manually when the film is locked and unlocked.

It will be appreciated that the film is removed from the drum by raising the slide from its fully locked position (FIG. 6) through its intermediate position (FIG. 5) to its fully opened position (FIG. 4) and removing the film.

The above-described arrangement provides a tight, rigid and secure attachment of the font to the font drum without need for spring means. It is to be understood that the above-described embodiment is merely an example of the application of the principles of the present invention. Numerous modifications will be apparent to those skilled in the art without departing from the spirit or scope of the invention as defined in the appended claims.

What is claimed is:

1. A font adapted to be secured to a font carrier having a plurality of font support pins projecting therefrom, said font comprising a piece of film containing characters arranged in desired sequence and having an elongated dimension terminating in first and second lateral edges, at least one area on said film adjacent said first lateral edge adapted to engage at least one of said support pins on said carrier, slide latching means secured to said film at said second lateral edge, said slide latching means including a slide bar mounted for sliding movement in a direction along the surface of said film transverse to said elongated dimension between an open position and a closed position, said slide bar including at least one engagement surface which engages at least one other of said support pins when said slide bar is in its closed position and is removed from said at least one other of said support pins when said slide bar is in its open position so that movement of said slide bar locks said font in position on said carrier.

2. A font adapted to be secured to a font carrier having a plurality of support pins projecting therefrom, said font comprising a piece of film containing characters arranged in desired sequence and having first and second lateral edges, at least one area on said film adjacent said first lateral edge adapted to engage at least one of said support pins on said font carrier, slide-latching means secured to said film at said second lateral edge, said slide latching means including a slide bar mounted for sliding movement relative to said film between a closed position wherein said slide bar engages at least one other of said support pins and an open position wherein said slide bar is removed from said at least one other of said support pins, said slide-latching means including cam means mounting said slide bar on said film for drawing said slide bar inwardly on said font as said slide is moved from its open position toward its closed position.

3. A font adapted to be secured to a font carrier having a plurality of support pins projecting therefrom, said font comprising a piece of film containing characters arranged in desired sequence and having first and second lateral edges, at least one area on said film adjacent said first lateral edge adapted to engage at least one of said support pins on said font carrier, slide-latching means secured to said film at said second lateral edge, said slide latching means including a slide bar mounted for sliding movement relative to said film between a closed position wherein said slide bar engages at least one other of said support pins and an open position wherein said slide bar is removed from said at least one other of said support pins, and cam means mounting said slide bar at said second edge so that when said slide bar is urged from its open position toward its closed position in a direction parallel to the second edge, said slide bar moves inwardly toward the center of said font for a first part of its path of travel and moves substantially parallel to said second edge for a second part of its path of travel, said font including at least one engagement surface angled with respect to said second edge which moves into contact with said at least one other support pin as said slide bar moves along said second part of its path of travel.

4. A font adapted to be secured to a font carrier having a plurality of support pins projecting therefrom, said font comprising a piece of film containing characters arranged in desired sequence and having first and second lateral edges, at least one area on said film adjacent said first lateral edge adapted to engage at least one of said support pins on said font carrier, slide-latching means secured to said film at said second lateral edge, said slide latching means including a slide bar mounted for sliding movement relative to said film and cam action means supporting said slide bar in a open position, an intermediate position and a closed position, sliding movement of said slide bar from said open position to said intermediate position simultaneously drawing said slide bar inwardly toward the center of said font, and movement of said slide bar from said intermediate position to said closed position being in a direction substantially parallel to said second edge, said slide bar including at least one engagement surface angled with respect to the path of travel of said slide bar between its intermediate position and its closed position so that said angled engagement surface is separate from said at least one other of said support pins when said slide bar is in said open position and securely contacts said at least one other of said support pins when said slide bar is in said closed position.

5. Apparatus in accordance with claim 4 wherein said at least one other of said support pins associated with said slide latching means includes a circular head portion and said angled engagement surface on said slide bar is beveled.

* * * * *